US007547110B2

(12) United States Patent
Vaught

(10) Patent No.: US 7,547,110 B2
(45) Date of Patent: Jun. 16, 2009

(54) CHRISTMAS LIGHT DISPLAY APPARATUS

(76) Inventor: Doran K. Vaught, 734 Janice Dr., Columbia, SC (US) 29210

( * ) Notice: Subject to any disclaimer, the term of this patent is extended or adjusted under 35 U.S.C. 154(b) by 84 days.

(21) Appl. No.: 11/555,486

(22) Filed: Nov. 1, 2006

(65) Prior Publication Data

US 2007/0097701 A1 May 3, 2007

Related U.S. Application Data

(60) Provisional application No. 60/596,958, filed on Nov. 1, 2005.

(51) Int. Cl.
*F21S 6/00* (2006.01)

(52) U.S. Cl. ..... 362/123; 362/249; 362/252; 362/288

(58) Field of Classification Search ..... 362/396, 362/567, 568, 123, 252, 122, 806, 457, 249, 362/288
See application file for complete search history.

(56) References Cited

U.S. PATENT DOCUMENTS

| | | | | |
|---|---|---|---|---|
| 5,057,976 | A * | 10/1991 | DuMong | 362/123 |
| 6,773,134 | B2 * | 8/2004 | Harvey | 362/123 |
| 7,249,866 | B1 * | 7/2007 | Tai | 362/249 |
| 2006/0245177 | A1 * | 11/2006 | Tsai | 362/123 |

* cited by examiner

*Primary Examiner*—Jacob Y Choi
(74) *Attorney, Agent, or Firm*—Calhoun Thomas, III; Samuel Alexander Long, Jr.

(57) ABSTRACT

The invention is an apparatus that facilitates the efficient arrangement of a Christmas light display and the efficient removal of that display. The invention accomplishes this through the use of a sliding rod and a multitude of alternating hanger members. The rod and hangers are slidingly attached to each other allowing the positioning of light strands around a columnar article in a knitting arrangement. Accordingly, when removal of the display is desired, an end restraint is removed and the rod is pulled out of the display by sliding through the hangers. The result, therefore, is that the hangers and their attached light strands fall freely from the columnar article.

2 Claims, 4 Drawing Sheets

CHRISTMAS LIGHT DISPLAY APPARATUS

BACKGROUND OF INVENTION

For many years since the advent of the electric light bulb, it has been popular during the Christmas Holiday season to hang and erect strands of electric lights for both interior and exterior display. Though they can vary, light strands often comprise many rather small light bulbs which are serially connected via electrically conductive wire. During the Christmas Holiday season as well as at other appropriate times such as Halloween, Easter, St. Patrick's Day, or even year-round, light strands are often arranged or otherwise attached to houses, trees, or other structures. As such, when the term "Christmas light" is used to the describe the invention herein, it is not intended to be limited only to light displays and light strands in use during the Christmas season; rather, the term refers to the broad category of light strand displays encompassing a variety of uses.

Unfortunately, under the current state of the art, the erection and display of light strands is also accompanied by several hardships placed upon the installer or owner of the display. First, light strand installation is often a rather unwieldy process. Typically, light strands are highly flexible and tend to only stay in place via some means of attachment by the installer. Without such means, the installer has difficulty arranging the strands to follow a desired form.

The means of attachment often employed by light strand installers described above represents a second problem currently associated with the art. Specifically, light strand attachment means are often destructive. This destructive nature derives from the unwieldy nature of the light strands described above coupled with the desire that the installation be only temporary. Because light strand installation is by its nature a temporary, yet annually recurring event, residual display markings from year to year will remain and compound over time. For instance, adhesive tape leaves residue just as nails or staples leave holes.

Perhaps the most undesirable aspect of light strand installation and display is the large amount of time associated with seasonal removal. The uninstaller of light strand displays must generally climb a ladder to reach top points of attachment and then manually detach each strand at each point of attachment. In order to achieve the desired positioning of lights, the strand is often attached in many places over its length. The attachments are direct between the strand and the surface of the fixture, building, or tree. This process is encumbered further by the necessity of unwinding the strand as the removal proceeds.

Thus, there exists a need in the art for a more efficient system of Christmas Light display.

SUMMARY OF THE INVENTION

The present invention relates to an apparatus that aids in the efficient display of Christmas Lights. The invention is designed to facilitate the organized display of light strands so that the installer has many choices of aesthetic arrangements. The invention contemplates weather resistant materials and construction such that it can be used in both interior and exterior applications. Further, and most importantly, the invention is designed to facilitate easy installation and removal of light strands. The installation and removal processes are characterized by minimal destructive elements and minimal labor investments.

The preferred embodiment of the invention is a rod that accommodates a set of sliding light strand hangers. The rod is somewhat flexible allowing the installer to bend the rod to accommodate various designs or object geometries. The sliding hangers are attached to the rod via a sliding connection and to the light strand via a hook connection. The installer can position the hangers along the rod as desired. The rod and the light strands are thus held in place via tension created by the rod and strands when displayed around a columnar article.

The present invention is particularly well suited toward and indeed contemplates use in a columnar display setting. Examples of columnar display settings are tree trunks and tree limbs, Christmas trees, sign posts, flag poles, porch rails, and building columns. When employed in such a use, the rod portion runs parallel to the length of the columnar article. The hangers are then slidingly positioned along the rod as the light strands are looped through the hook portion of the sliding hangers. The light strands wrap around the columnar article in a back and forth "knitting" arrangement facilitated by the invention's unique arrangement of alternating sliding hangers. This knitting arrangement helps the installer to arrange the light strands in an organized way and, most importantly, it makes post application removal quite easy and efficient.

As noted above, removal and take down of light strands is facilitated through the use of the present invention. To take down a light display, the user simply removes a bottom clip or stopper located near the end of the rod and then pulls the rod through the hangers, to which the strands are attached. Once the rod is removed, the light strands and attached hangers, having no means of attachment to the columnar article, simply release and fall off of the columnar article. The light strands thus slide with the hangers to the base of the column for easy removal and storage with no need for the tedious removal of individual means of attachment between the light strand and the columnar article as is currently associated with the art.

Further, as noted above, the invention and the accompanying light strands are held in place by tension and require no destructive means of attachment. Therefore, as the means of attachment between the lights strands and the columnar article are greatly reduced or even eliminated, so too is the resulting accumulation of destructive residue currently associated with the art.

DETAILED DESCRIPTION

Figure 1:
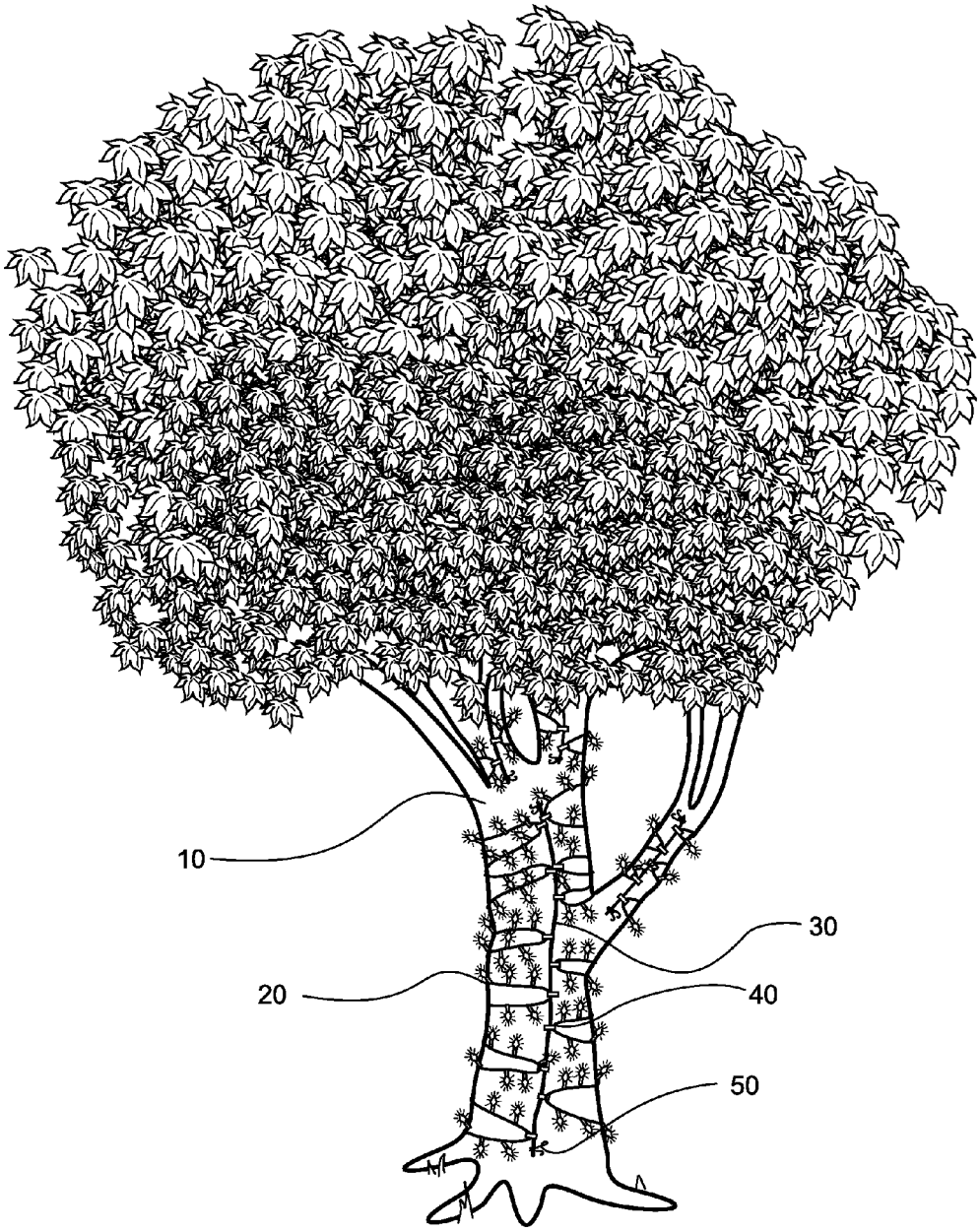
FIG. 1 is a view of multiple instances of the invention in use in a typical environment.
Figure 2:
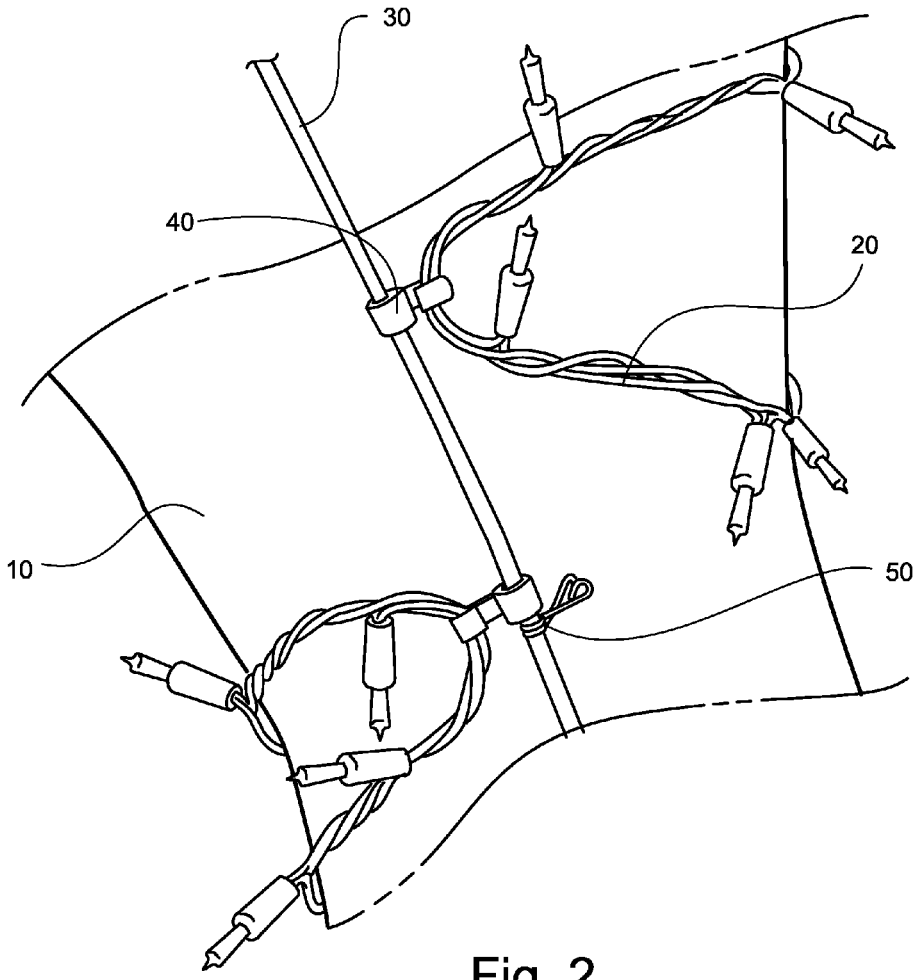
FIG. 2 is a perspective view of a segment of the invention showing the alternating connections to light strands.
Figure 3:
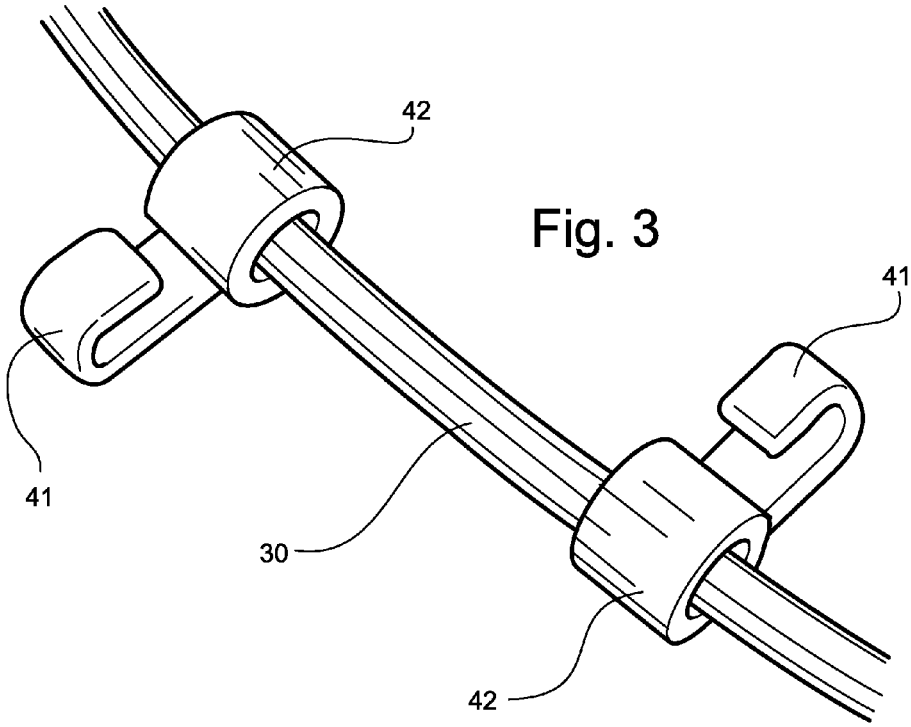
FIG. 3 is a closer view of the rod and two of the hooks that the invention utilizes in the preferred embodiment.
Figure 4:
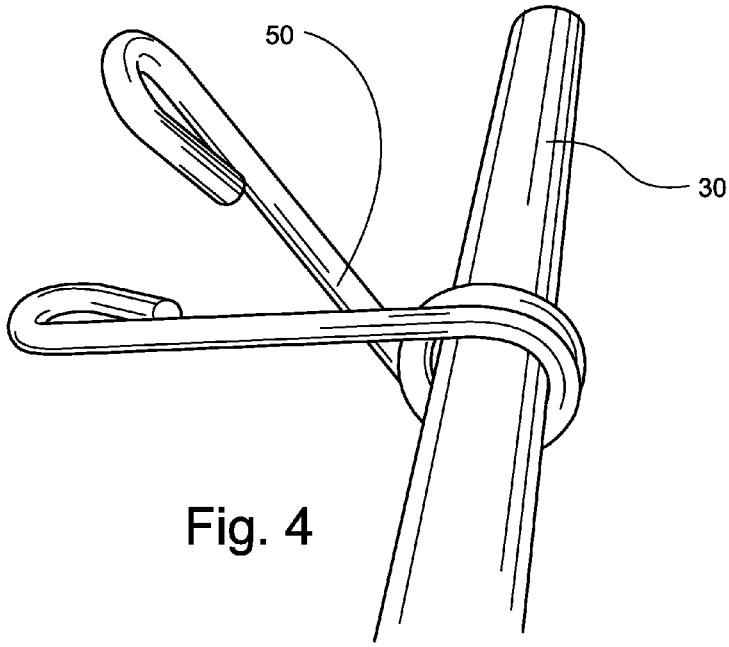
FIG. 4 is a closer view of the locking clip used to keep the sliding hook pieces from sliding off the end of the rod that passes through them when in use. In other embodiments, other forms and/or types of locking clips may be used.
Figure 5:
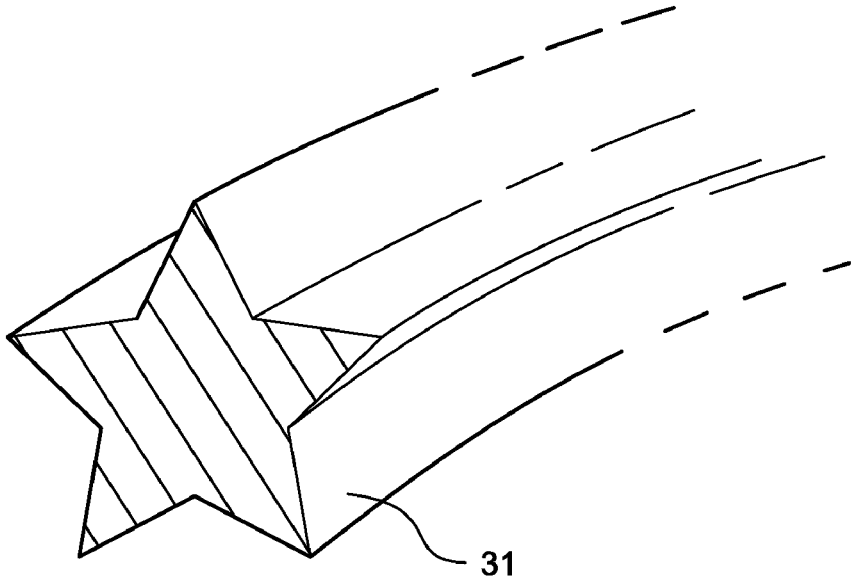
FIG. 5 is a view of a cross-section of the a rod having a star shape.

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

The preferred embodiment of the present invention contemplates a Christmas light display apparatus for use in facilitating the efficient installation and removal of Christmas lights. The fundamental purposes of the invention herein described are to enable light strands to be neatly hung and to enable the light strands to be easily removed. Therefore, in this embodiment, the invention contemplates an apparatus incorporating a rod system with sliding light strand hangers.

The rod (30) is made of lightweight weather resistant materials such as plastic. When the invention is used in a Christmas light display setting, the rod (30) runs the length of the display which is to be wrapped in Christmas lights (20). The rod (30) is designed to be flexible enough to follow possible curves in the display or facilitate specific designs yet rigid enough to not be too unwieldy during installation. In this embodiment, the rod (30) is made in the shape of a cylindrical tube of small diameter. However, the rod could be stars-shaped at a cross-section (31) or could be of any other uniform shape at the cross-section such that the sliding hangers (40) can slide along the rod (30).

A second element of the invention is the sliding hanger (40). The invention comprises a multitude of such sliding hangers (40). In this embodiment, the sliding hanger (40) is made of a lightweight weather resistant material such as plastic. The sliding hanger (40) serves as a point of connection between the rod (30) and the light strand (20) that is to be hung. The sliding hanger (40) has two ends, the rod end (42) and the hanger end (41). In this embodiment, the rod end (42) is somewhat cylindrical shaped and has a cylindrical cavity through which the rod passes. The diameter of the cylindrical cavity of the sliding hanger (40) is larger than that of the rod (30) so that the rod (30) can pass through the cavity. Thus, the sliding hanger (40) slidingly connects to the rod (30) at the rod end (42) of the sliding hanger (40) via the cylindrical cavity of the sliding hanger (40) such that motion is allowed only along a single axis. In alternate embodiments, the cavity through which the flexible rod (30) passes could be any shape so long as the sliding hanger (40) is able to slide along the rod (30).

The hanger end (41) of the sliding hanger (40) is hook shaped to accept a light strand (20). The width of the hook opening will vary depending on the type of light strand (20) desired to be displayed. In this embodiment, the sliding hangers (40) are connected to the light strands (20) which are held in place via a friction connection. This embodiment contemplates a sliding hanger (40) that accepts a standard Christmas light strand (20) but the invention includes hanger designs that accept a variety of different strand designs including such varied designs as rope lights.

As noted above, this embodiment contains a multitude of such sliding hangers (40) slidingly attached to the rod. The hangers are kept from sliding off of the end of the rod (30), and, when installed on a columnar article, the rod (30) is kept from sliding out of the sliding hangers (40), by a removable end restraint (50). The end restraint (50) in this embodiment uses a spring force to attach to the rod (30). However, many different types of restraints, clips, or stoppers could achieve the same function of this removable end restraint (50) and the spring clip represents only one such embodiment.

An important feature of the invention as seen in this embodiment is the nondestructive nature. The apparatus is not physically attached to the columnar article (10) and is held in place solely by the tension created by the light strand's "knitting" around the article. When the "knitting" of the light strands (20) is employed as in this embodiment, the sliding hangers (40) are positioned on the rod (30) so that the hanger end (41) is only oriented in the same direction on every other sliding hanger (40). In other words, the orientation of each successive sliding hanger (40) changes such that the open end of the hook on the hanger end (41) alternates from left (with the sliding hanger pointed to the left of the rod) to right (with the sliding hanger pointed to the right of the rod). The light strands (20) are then "knitted" around the article (10) by attaching to the first sliding hanger (40), then wrapping around columnar article (10) and attaching to the next successive sliding hanger (40), then reversing direction and wrapping around the article (10) and similarly attaching to the next sliding hanger (40), etc. . . . until the strand has successfully "knitted" the columnar article (10) via the apparatus. Accordingly, when removal of the strands (20) from the columnar article (10) is necessary, the removable end restraint (50) is removed and the rod (30) is pulled out and down the columnar article (10) and through the multitude of sliding hangers (40) such that the hangers (40) and their attached light strands (20) fall from the columnar article (10) in a zipper like manner.

I claim:

1. A method of knitting a light strand around a columnar article comprising the steps of:

a. providing a columnar article;

b. providing a light strand display apparatus comprising a multitude of linearly oriented successive hanger members and a flexible rod slidingly connected to said multitude of linearly oriented successive hanger members and a pair of end restraints removably connected to said flexible rod for restraining said successive hanger members from sliding off of said rod;

c. providing a light strand;

d. temporarily securing the light strand display apparatus parallel to said columnar article;

e. hooking said light strand through the first hanger member of said successive hanger members;

f. wrapping said light strand around said columnar article in a direction generally away from the first hanger member but further along said columnar article;

g. hooking said light strand through the next hanger member of said successive hanger members;

h. reversing direction and wrapping said light strand around the columnar article, and i. repeating steps (g) and (h) until said light strand is attached to the last successive hanger member.

2. The method of knitting a light strand around a columnar article of claim 1 wherein the linearly oriented successive hanger members of said light strand display apparatus provided in step (b) are arranged in an alternating opposing orientation.

* * * * *